US005274868A

United States Patent [19]

Sebor

[11] Patent Number: 5,274,868

[45] Date of Patent: Jan. 4, 1994

[54] ELEVATION LIMITER FOR SUBMERSIBLE SUCTION CLEANER

[76] Inventor: Pavel Sebor, 45 Highcliff Way, Northcliff Extension 12, Johannesburg, Transvall, South Africa

[21] Appl. No.: 880,666

[22] Filed: May 11, 1992

[30] Foreign Application Priority Data

Feb. 28, 1992 [ZA] South Africa ..... 92/1503

[51] Int. Cl.[5] ..... F04H 3/20

[52] U.S. Cl. ..... 15/1.7

[58] Field of Search ..... 15/1.7; 134/21, 168R

[56] References Cited

U.S. PATENT DOCUMENTS 4,156,948 6/1979 Chauvier et al. ..... 15/1.7
4,558,479 12/1985 Greskovics et al. ..... 15/1.7
4,589,986 5/1986 Greskovics et al. ..... 15/1.7
4,837,886 6/1989 Rawlins ..... 15/1.7
4,849,024 7/1989 Supra ..... 15/1.7
4,939,806 7/1990 Supra ..... 15/1.7

*Primary Examiner*—Harvey C. Hornsby
*Assistant Examiner*—Gary K. Graham
*Attorney, Agent, or Firm*—Allen, Dyer, Doppelt, Franjola & Milbrath

[57] ABSTRACT

A suction head useful with a self-propelled submersible pool cleaner having an elevation limiter formed as an inverted, generally U-shaped pipe or bulging body connected to the suction head and being dimensioned and disposed such that when an outward extremity of the limiter breaks a surface of water as the suction head climbs a submerged pool wall, gravitational force diminishes any forward impetus of the suction head.

3 Claims, 1 Drawing Sheet

ELEVATION LIMITER FOR SUBMERSIBLE SUCTION CLEANER

THIS invention relates to self-propelled submersible suction cleaners, particularly swimming pool suction cleaners. The term "self-propelled" herein means that the suction cleaner is not manually propelled but incorporates means, such as an oscillator, operated by the flow of water through the suction head, to cause propulsion of the device.

BACKGROUND OF THE INVENTION

Self-propelled suction cleaners for swimming pools are designed to climb the walls of the pool so that they may be swept clean. It is undesirable, however, for the suction chamber of the suction head of the cleaner to break the surface of the water since the suction head then draws in air via its exposed mouth which in turn impairs the operation of the filter pump.

SUMMARY OF THE INVENTION

It is an object of the invention to provide effective means for preventing the above undesired operation of a pool cleaner device.

According to the invention a self-propelled submersible suction cleaner includes a suction head having a formation extending forwardly from the upper side thereof and communicating with the mouth of the head but being closed at its upper end, and the structure being such that when the upper end of the pipe breaks the surface of the water as the suction head climbs a submerged wall, the gravitational force exerted by the formation balances the forward impetus of the suction head.

Further according to the invention the formation comprises pipe means.

Preferably the formation comprises a pipe which extends forwardly from the suction head.

As an alternative the formation may be defined as a forwardly projecting part of the housing itself.

It will be appreciated that there is an apparent gain in weight of the pipe or formation as it emerges from the surface of the water and the construction of the formation may be designed to ensure that this gain in weight balances the forward impetus of the suction cleaner head when it is closely spaced from the surface of the pool so that the suction head cleans the wall up to the surface but does not itself break the surface and draw in air.

Preferably a pipe formation comprises an inverted U or semi-circular-like member extending from one side of the suction head to the other, the pipe communicating at both ends with the mouth of the head. With a pipe structure of this nature the pipe fills with water easily when the suction head is submerged. When the suction head climbs a submerged wall and the pipe breaks the surface the water remains trapped in the pipe since both open ends thereof remain submerged.

As a non-preferred alternative a plurality of unconnected pipes in the nature of horns may be provided on the suction head.

THE DRAWING

In order to illustrate the invention two examples of self-propelled suction cleaner head in accordance therewith are described below with reference to the accompanying drawings in which:

FIG. 1 is a perspective view from the rear of the head incorporating a pipe formation; and FIG. 2 is a similar view of a head incorporating a bulge formation of the housing.

DETAILED DESCRIPTION

Figure 1:
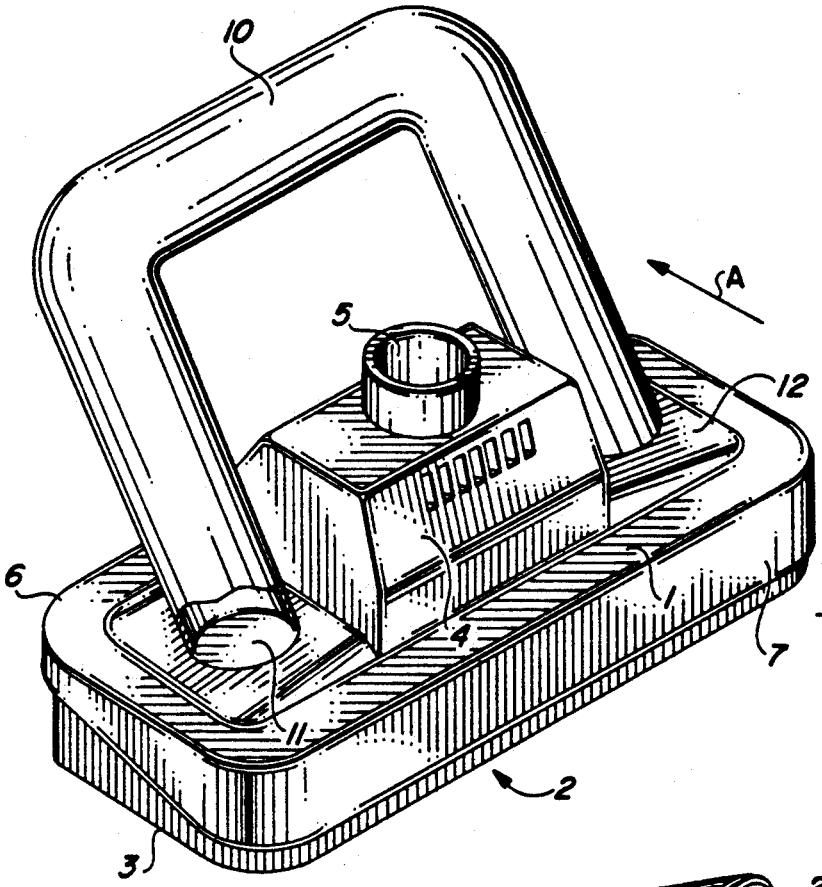

Referring to FIG. 1 of the drawings, the suction head of the suction cleaner comprises a substantially rectangular body or housing 1 having a downwardly directed mouth 2 around which are located bristles 3 on which the head rests. The body of the suction head defines a suction chamber 4 provided with a coupling 5 to which a suction hose (not shown) may be connected.

An oscillator (not shown) is located within the suction chamber 4 for operation by flow of water therepast caused by coupling of the suction chamber to a filter pump by the suction hose. The oscillator 6 pivots to and fro on its mounting under the action of the flow of water therepast, and in doing so it impacts on the body 1, causing a jerking motion of the head which is translated into forward motion by the spring cushion bristle action. Operation of the oscillator therefore acts as a propelling mechanism for the suction head which moves in the direction of arrow A so that side 6 of the suction head comprises the front and side 7 the rear thereof.

The suction head includes an inverted U-shaped pipe 10 connected at its ends to the body 1 towards the sides thereof so that the open ends 11 and 12 of the pipe communicate with the mouth of the head.

The pipe 10 extends upwardly and forwardly with respect to the suction head and when the latter is immersed in a pool the pipe 10 fills with water.

With forward motion of the suction head up the side wall of a pool, the suction head rises until the upper end of the pipe 10 breaks the surface of the water whilst the body 1 of the suction head is still located just below the surface. As the pipe 10 emerges from the surface of the water it undergoes an apparent gain in weight and the upward and forward extent of the pipe and its dimensions are designed so that the gain in weight balances the forward impetus of the head when the latter is just beneath the surface. In this way the pipe 10 operates as an elevation-limiting device preventing the head from breaking the surface of the water and drawing in air which would impair the operation of the pump.

Figure 2:
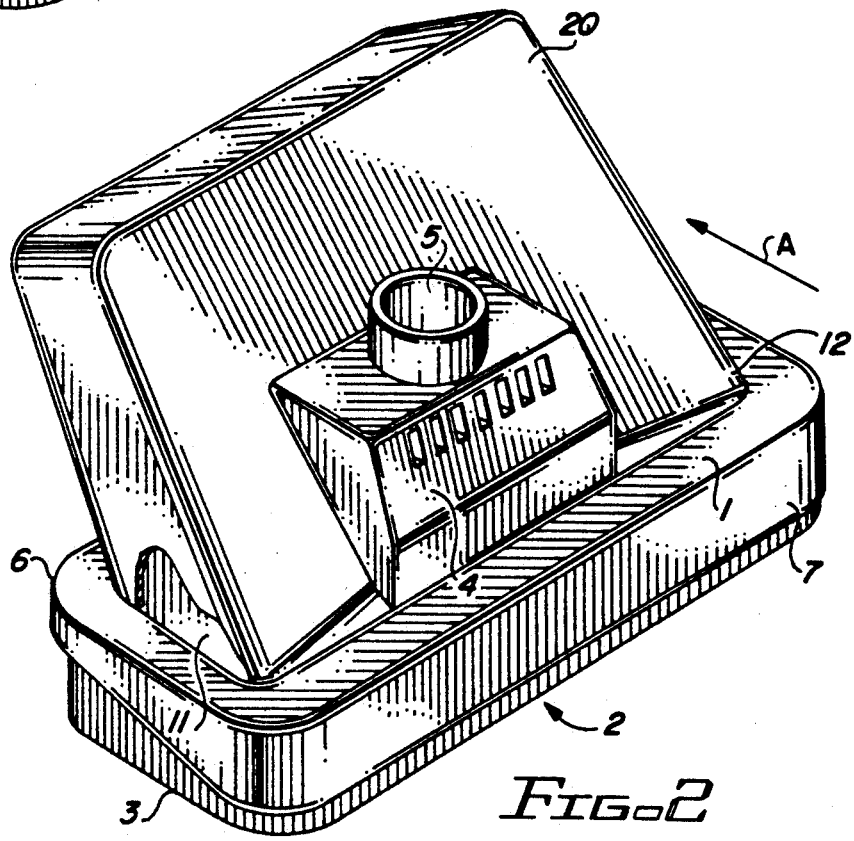

Referring now to FIG. 2, it will be seen that the pipe 10 of FIG. 1 is replaced by a bulge 20 of the housing 1 itself. The bulge 20 is hollow and communicates with the mouth of the head. It also projects upwardly and forwardly so that it operates in the same way to limit the elevation of the head as it climbs a wall of a pool.

What is claimed is:

1. A self-propelled pool cleaner for use in cleaning a submerged surface and walls in a pool, the pool cleaner comprising:

a housing, said housing having an upper side which defines front and rear edges, the housing further including a mouth opening for fluid communication with a submerged surface of a pool;

means connected with said housing for imparting a forward movement to said cleaner over the submerged surface and wall of the pool; and an elevation limiter formed as an inverted, generally U-shaped pipe fluidly communicating with the opening, the elevation limiter extending forwardly toward the front edge from the upper side of said housing and extending forwardly to a greater extent than said leading edge such that, as the cleaner climbs a pool wall, the limiter will break the water surface foremost to diminish any forward impetus of the cleaner due to gravitational force acting thereon.

2. A self-propelled pool cleaner for use in cleaning a submerged surface and walls in a pool, the pool cleaner comprising:

a housing, said housing having an upper side which defines front and rear edges, the housing further including a mouth opening for fluid communication with a submerged surface of a pool;

means connected with said housing for imparting a forward movement to said cleaner over the submerged surface and wall of the pool; and an elevation limiter formed as an inverted, generally U-shaped body connected to the housing and fluidly communicating with the opening, the elevation limiter extending forwardly toward the front edge from the upper side of said housing and extending forwardly to a greater extent than said leading edge such that, as the cleaner climbs a pool wall, the limiter will break the water surface foremost to diminish any forward impetus of the cleaner due to gravitational force acting thereon.

3. A self-propelled pool cleaner for use in cleaning a submerged surface and walls in a pool, the pool cleaner comprising:

a housing, said housing having an upper side which defines front and rear edges, the housing further including a mouth opening for fluid communication with a submerged surface of a pool;

means connected with said housing for imparting a forward movement to said cleaner over the submerged surface and wall of the pool; and an elevation limiter formed as an inverted, curved, generally tubular pipe connected at one of its ends to the housing and fluidly communicating with the opening, the elevation limiter extending forwardly toward the front edge from the upper side of said housing and extending forwardly to a greater extent than said leading edge such that, as the cleaner climbs a pool wall, the limiter will break the water surface foremost to diminish any forward impetus of the cleaner due to gravitational force acting thereon.

* * * * *

UNITED STATES PATENT AND TRADEMARK OFFICE
Certificate

Patent No. 5,274,868 Patented: January 4, 1994

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Pavel Sebor, Johannesburg, Transvall, South Africa; Dieter J. Rief, Santa Rosa, CA; and Herman Frentzel, Sausalito, CA.

Signed and Sealed this Thirteenth Day of September 2005.

JILL WARDEN
*Supervisory Patent Examiner*
Art Unit 1743